United States Patent [19]

Lindsay et al.

[11] Patent Number: 4,557,831

[45] Date of Patent: Dec. 10, 1985

[54] CENTRIFUGAL FILTER ASSEMBLY

[75] Inventors: Frederick E. Lindsay, Greencastle, Pa.; Willis R. Alexander, Hagerstown, Md.

[73] Assignee: Mack Trucks, Inc., Hagerstown, Md.

[21] Appl. No.: 599,484

[22] Filed: Apr. 12, 1984

[51] Int. Cl.[4] ..... B04B 9/06

[52] U.S. Cl. ..... 210/232; 210/360.1; 210/380.1; 494/49

[58] Field of Search ..... 210/232, 360.1, 380.1; 494/49

[56] References Cited

U.S. PATENT DOCUMENTS

| | | | |
|---|---|---|---|
| 3,599,792 | 8/1971 | Stripp | 210/360.1 |
| 3,615,018 | 10/1971 | Johnson | 210/232 |
| 3,774,769 | 11/1973 | Smith | 210/232 |
| 3,887,467 | 6/1975 | Johnson | 210/232 |
| 4,051,036 | 9/1977 | Conrad et al. | 210/232 |
| 4,106,689 | 8/1978 | Kozulla | 233/23 R |
| 4,288,030 | 9/1981 | Beazley et al. | 233/23 R |
| 4,346,009 | 8/1982 | Alexander et al. | 210/512 |
| 4,400,167 | 8/1983 | Beazley et al. | 494/49 |
| 4,431,540 | 2/1984 | Budzich | 210/380.1 |
| 4,498,898 | 2/1985 | Haggett | 494/49 |

FOREIGN PATENT DOCUMENTS

| | | | |
|---|---|---|---|
| 1035542 | 3/1965 | United Kingdom . | |
| 957968 | 9/1982 | U.S.S.R. | 210/360.1 |

*Primary Examiner*—Tim Miles

*Attorney, Agent, or Firm*—Bernard, Rothwell & Brown

[57] ABSTRACT

A centrifugal oil filter assembly has a disposable rotor mounted on a reusable permanent shaft which is screwed into an adaptor mounting the filter to an engine block. A reusable permanent open top filter casing is connected to the support shaft and sealed at its top by a replaceable gasket to a vented top member carried by the adaptor so that by rotating the filter casing the shaft is unscrewed and the rotor (and gasket) can be replaced.

12 Claims, 4 Drawing Figures

FIG. 2
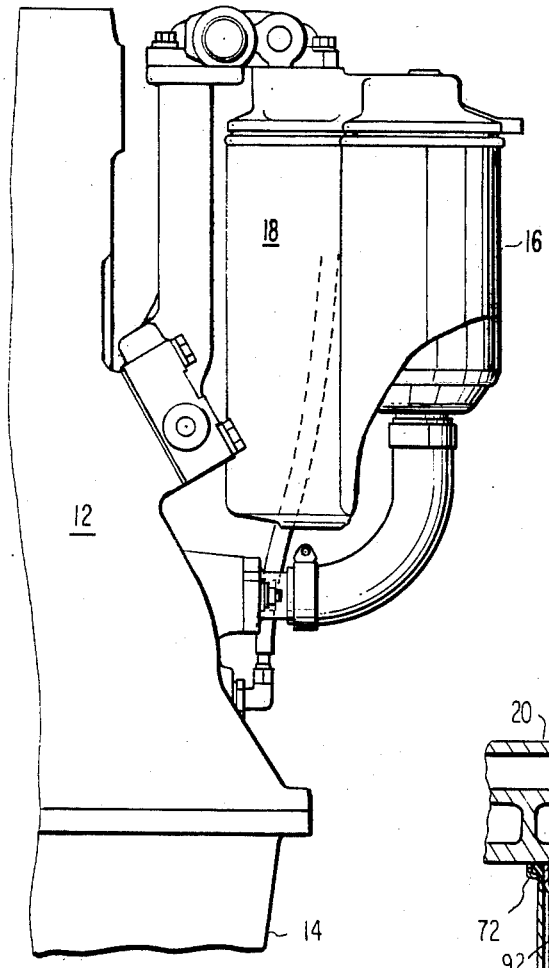
FIG. 1
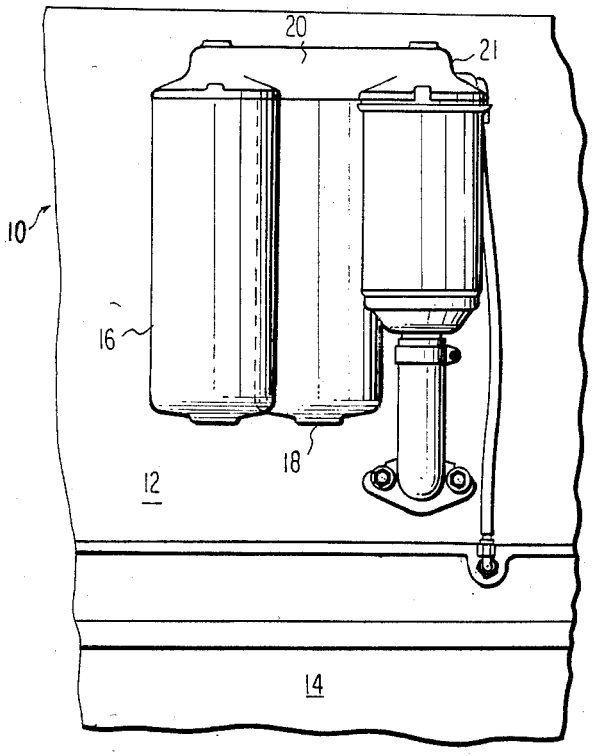
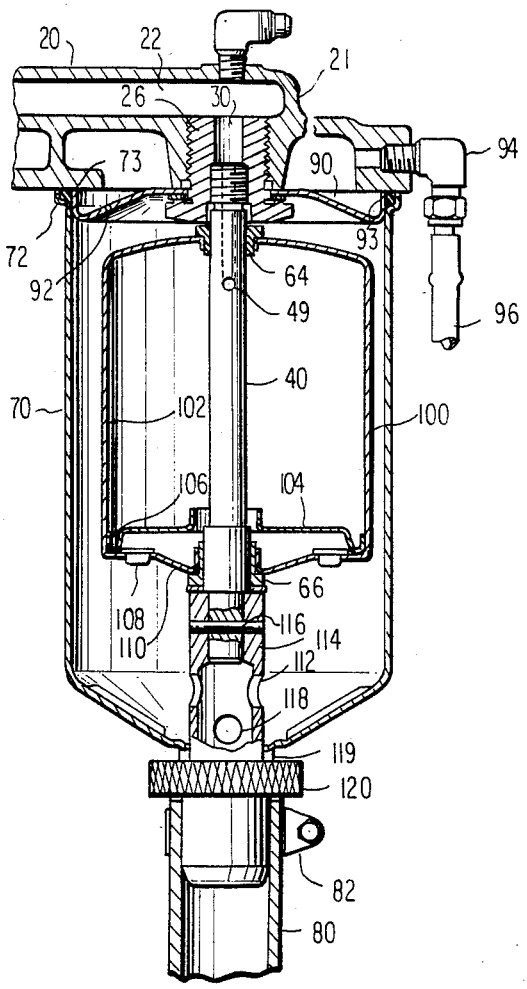
FIG. 4

CENTRIFUGAL FILTER ASSEMBLY

BACKGROUND OF THE INVENTION

1. Field of the Invention

This invention relates to improvements in centrifugal filters and particularly to a unique centrifugal oil filter-adaptor assembly in which only the rotor is disposable.

2. Prior Art

Centrifugal filters for separating contaminants from contaminated liquids and particularly for separating solid matter from oil are known in the art, especially for use in internal combustion engines. Numerous examples of such exist in the prior art of centrifugal oil filters.

Centrifugal oil filters greatly improve engine durability, especially the durability of piston rings, due to the removal of contaminants from the oil. For example, while conventional media filters can remove contaminants down to the particle size range of about 10 microns, centrifugal filters can remove contaminants down to a particle size of ½ micron. However centrifugal filters have not found favor in the U.S. due in large part to their original cost and the maintenance cost of cleaning the rotor.

It is therefore highly desirable to have a centrifugal oil filter which is inexpensive and which is disposable. That is, a desirable filter would be constructed of such material that it would be inexpensive enough to be completely disposable after it had become clogged with dirt filtered from the oil, while at the same time it would be maintenance-free and efficient while in use.

The advantages of centrifugal oil filters over conventional filters and the desirability of a disposable centrifugal filter are taught in numerous prior art patents, for example, U.S. Pat. Nos. 4,106,689, 4,288,030 and 4,400,167. In all of these patents there is an attempt to make the construction inexpensive so that the entire filter rotor, casing and all, may be discarded after use. Such constructions have not met with a significant degree of commercial success for one reason or another. Possibly one reason is the difficulty in making an entirely disposable filter sturdy enough to adequately support an efficient and maintenance-free rotor and/or inexpensive enough so as to make it economical.

It is also known in the art to provide centrifugal oil filters in which only a rotor unit is disposable. That is, the filter assembly was of such construction that it could be opened and the rotor unit discarded after it became dirty from accumulation of material filtered from the oil. Such is taught, for example, in British Patent Specification No. 1,035,542.

Even in view of the teachings of the prior art as set forth above, there remains a problem of having a simple, effective, maintenance-free and inexpensive centrifugal oil filter construction in which the rotor only may be discarded while providing a rigid permanent support shaft for the rotor as well as a means for removing and installing the filter with conventional tools.

Additionally, in the art of centrifugal filters it is known to be desirable to vent the inside of a casing in which a centrifugal rotor operates however, such prior art venting was done to atmosphere, creating pollution control problems.

SUMMARY OF THIS INVENTION

This invention provides a centrifugal oil filter in which only the rotor is disposable. The construction is unique in that the rotor is inexpensively constructed with a pair of bearings and a reusable support shaft is fitted to an adaptor on the engine block. An outer filter casing is also constructed to be reusable and has an open top which is closed by a stamped metal top secured to the adaptor. The outer casing is sealed by a gasket held by the stamped top, the gasket is adapted to be removed and replaced at the time the rotor is replaced. Thus, to change the centrifugal filter only the gasket and the rotor are discarded and replaced. The rotor support shaft is held at its lower end by the outer casing and is screwed into a fitting in the adaptor. The fitting also holds the stamped top and provides a passage for oil to be filtered. The top member has a vent opening which connects with passageways in the adaptor and a vent connection so that air pressure inside of the casing may be equalized with crankcase pressure.

BRIEF DESCRIPTION OF THE DRAWINGS

FIG. 1 is a side view elevation of an engine with filters thereon including the centrifugal filter of this invention.

FIG. 2 is a front elevation view of the engine and filters.

FIG. 4 is a sectional elevation view of another embodiment of the filter of this invention.

DETAILED DESCRIPTION OF THE PREFERRED EMBODIMENTS

Figure 3:
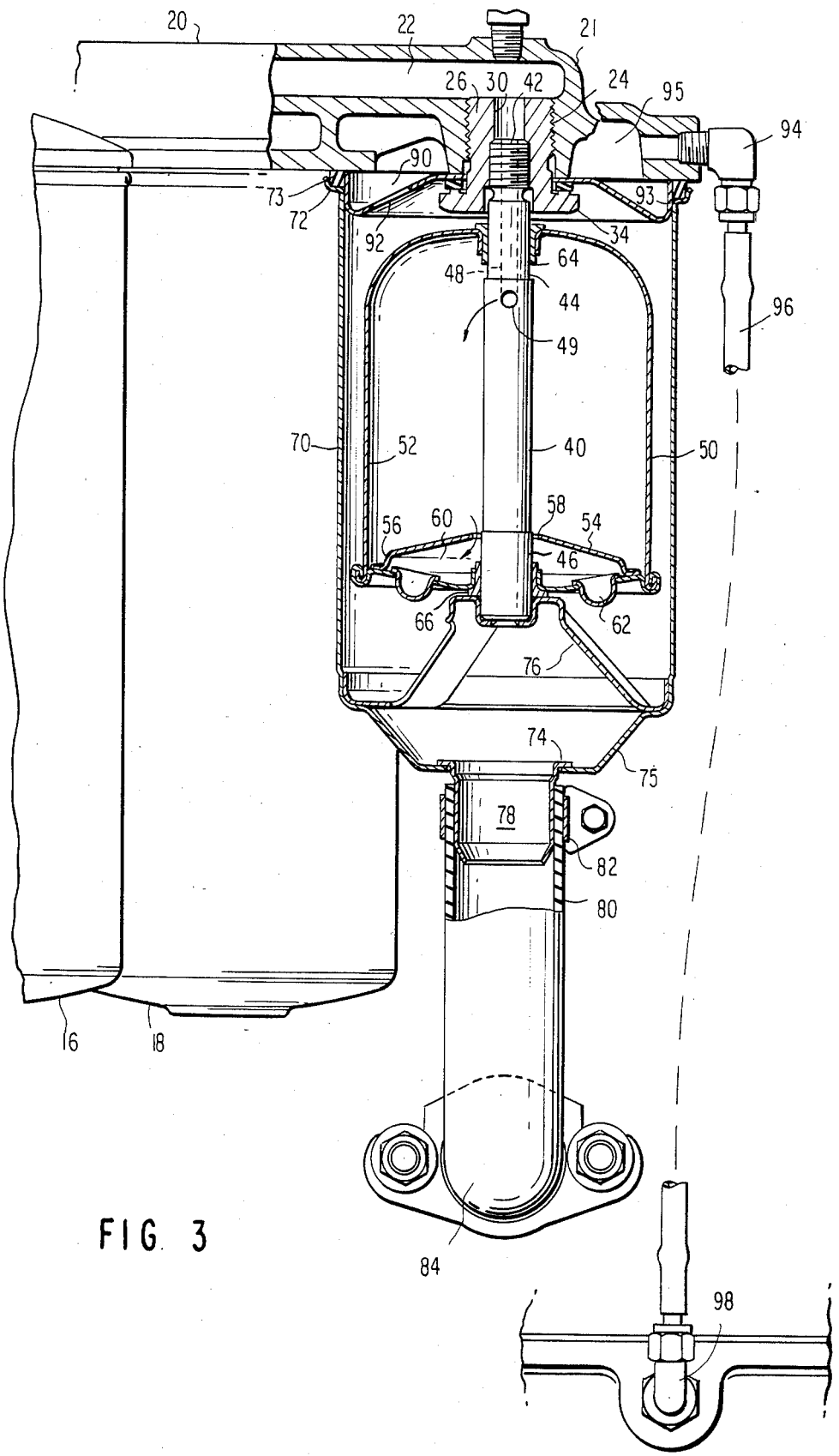
FIG. 3 is an enlarged sectional elevation view of the filter of this invention including its mounting.

With reference to FIGS. 1 and 2 there is shown an engine 10 which contains engine oil to be filtered. The engine has a block 12 and a crankcase 14 as is conventional. Conventional media-type filters 16 and 18 are mounted to filter engine oil and return it to the engine in a conventional manner. Oil flows into and out of filters 16 and 18 through an adaptor plate 20 as is known in the art.

A side portion 21 of adaptor plate 20 has a passage 22 therein for accepting a portion of the oil exiting from the other filters and passing it to the centrifugal filter of this invention, see FIG. 3. The adaptor plate portion 21 also has a threaded passageway 24 therein extending into chamber 22. A fitting 26 is threaded in passageway 24. Fitting 26 has a central oil passage 30 which is at least partially threaded. Fitting 26 also includes a head portion 34 which can be gripped for turning and screwing the fitting into the adaptor plate 20.

A solid, rigid, and permanent rotor support shaft 40 has an upper threaded end portion 42 screwing into the fitting, a reduced diameter section 44 and an increased diameter section 46 at the lower end. The support shaft 40 has a centrally located bore which ends in a transverse bore 49 so that oil to be filtered may flow therefrom as shown by the arrow in FIG. 3.

Mounted onto the support shaft is a removable, replaceable rotor 50. This rotor may be substantially the same construction as the rotor shown in FIG. 3 of U.S. Pat. No. 4,400,167, or it may be like the rotor in U.S. Pat. No. 4,346,009, see FIG. 4. The rotor must be inexpensive enough to be disposable and efficient enough to accomplish its function, otherwise the rotor construction per se is not part of this invention. The rotor 50 includes a hollow rotatable shell casing 52 containing an inclined shelf 54 providing a pocket 56 where contaminants are collected, the shelf having an opening 58 adjacent the central shaft where the clean oil may pass to nozzle area 60 as shown by the arrow in FIG. 3. Conventional nozzles 62 allow oil to exit the rotor and at the same time provide a reaction force to rotate the rotor.

The hollow rotor is provided with a pair of aligned bearing means, an upper bearing 64 and a lower bearing 66 of the same diameter as the portions of the support shaft on which they rotate. Typically, at 70 psi oil pressure the rotor will spin at about 7,000 rpm and at 40 psi will rotate at about 5,000 rpm.

The oil filter is provided with a permanent and reusable outer filter casing 70 which terminates in a top lip 72, the open top of the casing 70 being of a greater diameter than the rotor. A removable and disposable gasket 73 seals the top lip 72 of casing 70.

A bottom portion 75 of the outer casing tapers down to an opening 74 for outlet of the filtered oil. A spider assembly 76 or the like provides nonrotatable support and connection to the bottom end of the rotor shaft 40. An outlet spigot 78 is provided at the bottom of the outer casing 70 for the attachment of a tubular connection 80 by means of a conventional clamp 82. The tubular connection 80 provides a path for oil flow from the filter into the engine block via fitting 84.

Positioned at the top of the outer casing 70 is a top member 90 preferably formed of stamped sheet metal and having vent holes 92 therein. The gasket 73 is adjacent an outer wall 93 of the top member 90. The stamped top member is a significant part of the invention. It is of such diameter as to hold gasket 73 in place on its outer wall 93 during installation of the outer casing 70 and wall 93 also provides a piloting surface so that casing 70 is aligned concentrically with the threaded hole in fitting 26 so that the threaded shaft will be aligned when installing it.

Top member 90 is immediately below a passageway 95 in the adaptor plate. Communicating with passageway 95 in the adaptor plate is a fitting 94 leading via closed tubular connection line 96 and fitting 98 to the crankcase. This arrangement provides equalization of the air pressure in outer casing 70 with that in crankcase 14 so as to allow oil to flow easily and prevent oil back-up as well as to prevent slowing or stopping of the rotor by oil back-up.

The operation of the invention in connection with filtering of engine oil will now be described. Oil to be filtered flows from the engine through the media filters 16 and 18 and returns to the engine. However, a small percentage of the oil filtered by the media filters is bypassed through the centrifugal filter of this invention by flowing through passage 22 in the adaptor plate 20 down the central oil passage 30 of the fitting 26 into the central bore 48 of the rotor support shaft 40 exiting through exit bore 49 into the inside of the rotor 50. The rotor 50 spins on the support shaft 40 by virtue of the reaction torque of the oil exiting the nozzle openings 62 as is known in the art. During spinning of the rotor, contaminant particles are filtered centrifugally by moving outwardly against the walls of the rotor and eventually falling down and collecting in rotor pocket 56, as known in the art. The clean oil passes out through the tubular connection 80 into the engine crankcase 14. During operation it is necessary to prevent build-up of pressure in the closed space within outer casing 70 where rotor 50 operates. This is accomplished through vent holes 92 in top member 90, passageway 95, fitting 94 and vent line 96 establishing a path of fluid communication to the crankcase to equalize the pressure between the crankcase and the inside of the filter casing.

In order to replace the disposable rotor 50 when it becomes dirty with filtered particles from the oil, the hose clamp 82 is loosened and the tubular hose 80 is removed from the bottom of the casing 70. The outer casing 70 is then spun counterclockwise to unscrew the shaft 40 from fitting 26. The casing 70 breaks open at its top lip 72 around gasket 73, leaving top member 90 attached to the adaptor plate 20 by fitting 26. With the outer casing 70 open at the top the rotor 50 containing the contaminant particles is easily slipped off the top end of shaft 40 and is thrown away. A new clean rotor 50 is slipped over the top of shaft 40, the gasket 73 is replaced and the shaft 40 is screwed back into the fitting 26 by turning the outer casing 70 with a conventional oil filter tool while being guided or piloted by outer wall 93 of top member 90. The top lip 72 of outer casing 70 moves up and seals against the replaced gasket 73 and the tubular hose 80 is then reconnected to the outlet 78 at the bottom of the outer casing 70.

FIG. 4 is a sectional view similar to FIG. 3 showing an alternative and preferred embodiment. In FIG. 4 the elements and components that are identical to those of FIG. 3 are identified by the same reference numerals. As noted above, however, the rotor, per se, is of a construction like the rotor of U.S. Pat. No. 4,346,009. The rotor 100 is formed with an outer shell 102 having a bottom shelf 104 which leaves a space between the inner periphery of the shelf and the shaft 40. A contaminant-collecting pocket 106 is provided at the outer edge of the shelf. A series of nozzles 108 are mounted in the bottom of the rotor 100. The rotor is freely rotatable on shaft 40 via bearings 64 and 66. The shaft 40 in addition to having a threaded upper end for threading into fitting 26 has its lower end provided with an extension 112 which is fixedly connected to a tubular member 114 via pin connection 116. The tubular member 114 has appropriate openings 118 for oil to flow into the hollow tubular member and out through tube 80 into the crankcase. The filter casing 70 has its lower end 119 rigidly attached to tubular member 114, e.g., by welding. A knurled gripping member 120 is also rigidly secured on the member 114 so as to function as a means for rotating the filter casing 70 and shaft 40 for installing or removing the filter rotor 100.

In the FIG. 4 embodiment the function of filtering the oil centrifugally is the same as in the prior embodiment. However, the arrangement for removing the rotor is different in that when it is desired to remove the rotor 100 after it has become contaminated, the gripping member 120 is turned to unscrew the shaft 40 and thereby separate the outer casing 70 from the top member 90. Of course, the clamp 82 and hose 80 have been removed first. When this outer casing 70 is open at its top, the contaminated rotor 100 may be removed from the top of the shaft 40 and a new rotor is inserted on the shaft. The filter is then reassembled after first replacing gasket 73 by screwing the shaft 40 into fitting 26 utilizing the gripping member 120 to accomplish the same. The clamp 70 and tube 82 are reconnected and a clean filter is ready for use.

This alternative construction eliminates the need for the spider 76 of the FIG. 3 embodiment and provides a more secure and rigid connection between the outer casing 70 and the shaft 40.

As a non-limiting example, a disposable rotor centrifugal filter assembly of this invention installed on a Mack truck diesel would use two or three full flow paper media filters in parallel (which would filter particles down to 10 micron size) with the centrifugal filter assembly used as a bypass filter for filtering 1.5 gallons of oil per minute and particles down to a size of ½ microns. The oil is filtered so effectively that the sump size in the crankcase can be cut from 54 to 36 quarts while maintaining a 25,000 mile oil and filter change cycle. Alternatively with a 54 quart sump tests show the engine can go 50,000 miles between oil and filter changes. The filter of this invention will increase engine durability and require less maintenance.

As can be seen, the screw-in, reusable shaft provides the necessary stability, the top member provides for proper alignment and guidance when screwing the shaft into the adaptor fitting and holds the gasket in place during installation, the adaptor passageways receive only oil filtered by the media filters, thus keeping dirty oil out of the centrifugal filter, the vent arrangement equalizes pressure between the crankcase and the inside of the filter, the gasket provides a good seal, but is removable and replaceable each time the filter is replaced, and the adaptor mounts all the filters to the engine block, thus eliminating the problem of leaky lines to and from the filters. In short, the entire centrifugal filter is highly efficient, stable, economical, and easily replaceable.

What is claimed is:

1. A centrifugal oil filter assembly for an engine having engine oil to be filtered, an engine block and a crankcase, the filter being of the type having a rotor with a hollow rotatable shell, means for collecting contaminants in oil to be filtered at the inside of the hollow shell casing, exit openings for clean oil to exit from the hollow shell and simultaneously provide a reaction torque thereto, aligned bearing means at the top and bottom of the rotor, and an outer oil filter casing housing the hollow rotatable shell, the outer filter casing having an outlet opening with a fitting for connection to a tubular conduit to return filtered oil to the engine, and means for supplying oil to be filtered from the engine to the inside of the hollow shell casing through the bearing means at the top of the shell casing, with improvements for providing an arrangement in which the rotor is disposable, discardable and replaceable, while the outer filter casing of the filter assembly is permanent and reuseable, the improvements comprising:

(a) the rotor being constructed of material such that it can be economically disposed of;

(b) the outer filter casing having an open top of a diameter greater than the diameter of the rotor;

(c) a top member for closing the open top of the outer casing;

(d) an adaptor plate means mounting the top member for the outer shell casing;

(e) a rigid rotor support shaft threadedly connected to the adaptor plate means and fixedly connected to the outer casing, the shaft having a central passage partially therein with an exit opening into the rotor, the shaft providing support for the bearings on the rotor; and (f) means for establishing a path of fluid communication from the inside of the outer casing through the top member to the pressure of the engine crankcase.

2. A centrifugal oil filter as in claim 1 wherein the last named means includes a vent opening in the top member, a vent passage in the adaptor plate means above the top member, and a closed connection from the adaptor plate means passages connecting to the pressure of the engine crankcase.

3. A centrifugal oil filter as in claim 1 further comprising a threaded fitting with a passage centrally located therein, the adaptor plate means mounting the threaded fitting and the threaded fitting mounting the support shaft and holding the top member.

4. A centrifugal oil filter as claimed in claim 1 further comprising a removable gasket positioned between the adaptor means and the top of the open casing for sealing the open casing and preventing oil leakage therefrom.

5. A centrifugal oil filter assembly for an engine having engine oil to be filtered, an engine block and crankcase, the filter being of the type having a rotor to accomplish centrifugal separation of oil from particles in the oil, the centrifugal oil filter assembly comprising in combination:

(a) a discardable rotor including;

(i) a hollow rotatable shell, (ii) means for collecting contaminants inside the hollow shell, (iii) exit openings for clean oil to exit from the hollow shell and provide a reaction torque thereto, (iv) aligned bearing means at the top and bottom of the shell, and (v) the rotor being constructed of material such that it can be economically disposed of, (b) a permanent reusable outer filter casing including;

(i) an open top of diameter greater than the diameter of the rotor, (ii) an outlet opening with a fitting for a tubular conduit to return filtered oil to the engine, (c) adaptor plate means for mounting the filter having oil passages therein for passing oil to be filtered to the filter, (d) removable and reusable rotor support shaft including;

(i) means removably connecting the support shaft to the adaptor means, (ii) passage means so that oil to be filtered may flow from the adaptor plate means oil passages to the center of the partially hollow rotor shaft and then out from an opening in the shaft to the inside of the rotor;

(iii) means for fixedly connecting the support shaft to the outer filter casing so that by rotating the casing the shaft can be connected or disconnected from the adaptor means, (e) a top member for the open casing, the top member fixedly attached to the adaptor plate means and extending radially outwardly of the rotor support shaft to close the top of the open top casing and leave a vent space thereabove, (f) means defining a vent in the top member, (g) replaceable gasket means positioned on the top member and sealing the top member and the top of the open casing, and (h) means defining a closed passageway from the space above the top member to the engine so that the pressure inside the outer casing may be equalized with the pressure in the crankcase.

6. A centrifugal oil filter as defined in claim 5 wherein the means for connecting the support shaft to the adaptor plate means includes a threaded hollow fitting with internal threads accommodating the shaft and external threads for securing the fitting to the adaptor plate, and the top end of the support shaft is threaded for screwing into the fitting.

7. A centrifugal oil filter as defined in claim 6 wherein the top member is fixedly attached to the adaptor plate by being pressed thereagainst by the threaded hollow fitting and the top member has a vertical outer wall for accommodating the replaceable gasket and piloting the outer filter casing during installation.

8. A centrifugal oil filter as in claim 5 further comprising; at least one media filter also mounted on the adaptor plate, and passageways in the adaptor plate connecting the outlet of the media filter to the centrifugal filter inlet.

9. A centrifugal filter as in claim 5 wherein the means for fixedly connecting the support shaft to the outer casing comprises a spider assembly connecting the inside of the outer casing to the support shaft near the bottom thereof.

10. A centrifugal filter as in claim 5 wherein the means for fixedly connecting the support shaft to the outer casing comprises a tubular member rigidly connected to the bottom of the support shaft and to the casing and coaxial therewith.

11. A centrifugal filter as in claim 10 wherein the tubular member includes an enlarged gripping surface for turning the outer filter casing and support shaft.

12. A centrifugal oil filter as in claim 5 wherein the top member is a formed sheet metal member with an outer vertical wall having a diameter slightly less than the inside diameter of the open top of the outer filter casing to accommodate the gasket and to pilot the open top of the outer filter casing during installation, and further comprising an oil return conduit connected from the outlet opening of the outer filter casing directly to the engine block.

* * * * *